United States Patent [19]

Sheng

[11] Patent Number: 4,552,296

[45] Date of Patent: Nov. 12, 1985

[54] STAPLING GUN

[76] Inventor: Wang Sheng, 4F. No. 2, Lane 350, Chung Ho Rd., Chung Ho City, Taipei Hsien, Taiwan

[21] Appl. No.: 543,483

[22] Filed: Oct. 19, 1983

[51] Int. Cl.[4] ..... B25C 1/02

[52] U.S. Cl. ..... 227/109; 227/132; 227/119

[58] Field of Search ..... 227/120, 125, 127, 132, 227/109, 119

[56] References Cited

U.S. PATENT DOCUMENTS

| | | | |
|---|---|---|---|
| 2,285,512 | 6/1942 | Harley | 227/132 |
| 2,618,779 | 11/1952 | Byard | 227/125 |
| 2,746,043 | 5/1956 | Heller | 227/132 X |
| 2,754,515 | 7/1956 | Ring | 227/132 X |
| 2,775,763 | 1/1957 | Flammer | 227/132 X |
| 4,358,043 | 11/1982 | Chi | 227/132 X |

*Primary Examiner*—Paul A. Bell

*Attorney, Agent, or Firm*—T. K. Sung

[57] ABSTRACT

The present invention relates to a stapling gun and in particular to one comprising a main body portion, a pusher, a guide way, a drives, a covering plate and an adjustable wire attachment, characterized in that the stapling gun can be used with various types of staples on the market.

1 Claim, 16 Drawing Figures

FIG. 10A
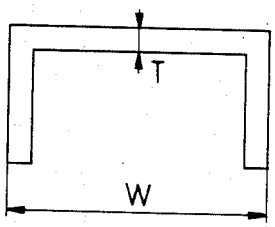
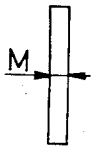
FIG. 10B

STAPLING GUN

BACKGROUND OF THE INVENTION

So far, every kind of stapling gun on the market is adapted for use with only one type of staple, thus causing much inconvenience in use. In particular, there are many brands of staples on sale but they are of different sizes.

The staples widely used in Canada and United States are of ARROW, SWINGLINE, SENCO, SEARS AND MONTGOMERY WARD, the sizes of which are as follows:

| | ARROW | SWINGLINE | SENCO | SEARS | MONTGOMERY WARD |
|---|---|---|---|---|---|
| T | 0.60 mm | 0.55 mm | 0.50 mm | 0.55 mm | 0.50 mm |
| M | 1.20 mm | 1.20 mm | 1.25 mm | 1.30 mm | 1.30 mm |
| W | 10.65 mm | 13.28 mm | 13.28 mm | 12.40 mm | 12.80 mm |

As can be seen in the above tabulation, ARROW, SWINGLINE, SENCO, SEARS and MONTGOMERY WARD have different sizes. In this way, if there is a stapling gun which can be used with various types of staples, it is certain that the stapling gun will meet the requirements of consumers. Thus, the inventor of this invention creates a stapling gun which is designed so that it can be adapted for use with most staples widely used in Canada and United States.

SUMMARY

It is a primary object of the present invention to provide a stapling gun which is especially designed for use with various types of staples.

It is another object of the present invention to provide a stapling gun which may exert a strong force to press a staple into a surface so as to hold a flexible wire or the like in position.

It is still another object of the present invention to provide a stapling gun which is easily operated.

It is still another object of the present invention to provide a stapling gun which is economic to produce.

It is a further object of the present invention to provide a stapling gun which may obviate and mitigate the drawbacks of the prior art stapling guns.

It is still a further object of the present invention to provide a stapling gun equipped with an adjustable wire attachment for protecting the wire or the like which is to be held in position.

Other objects and a fuller understanding of the present invention will be obtained by those skilled in the art when the following detailed description of the best mode contemplated for practicing the invention has been read in conjunction with the accompanying drawings wherein like numerals refer to like or similar part and in which:

BRIEF DESCRIPTION OF THE DRAWINGS

FIGS. 8a, 8b and 8c show the relationship between the driver of the stapling gun and the staple;

FIGS. 10a and 10b show the front and side views of a widely used staple.

DETAILED DESCRIPTION OF THE PREFERRED EMBODIMENT

Figure 1:
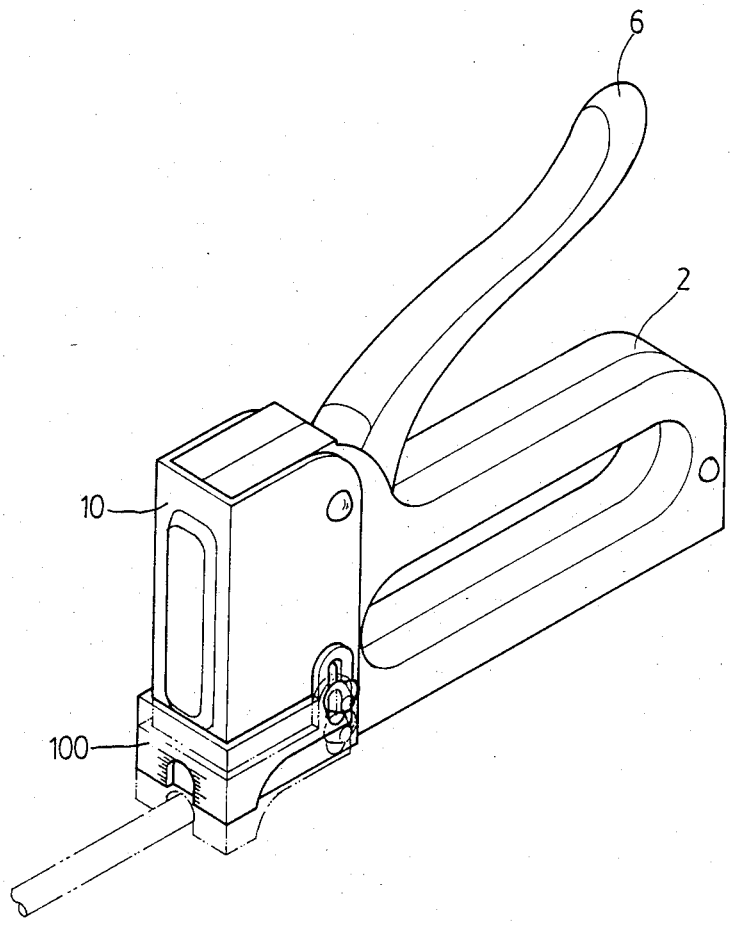
FIG. 1 is a perspective view of a stapling gun of a preferred embodiment according to the present invention.

Referring to the drawings and in particular to FIG. 1 thereof, the stapling gun according to the present invention mainly comprises a pusher (1), a main body portion (2), a guide way (3), a driver (4), a covering plate (10) and an adjustable wire attachment (100). The main body portion (2) is mainly constituted by a handle (6), a hook (61) and a spring leaf (7). The driver (4) is provided with an opening (41) serving to engage with hook (61) and a slot (42) serving to connect with the spring leaf (7). The covering plate (10) is used to cover the front end of the main body portion (2). The handle (6) is pivotally mounted on the main body portion (2). At the lower part of the main body portion (2) is mounted the guide way (3) for accomodating staples. The pusher (1), which cooperates with the guide way (3), may be inserted into the guide way (3) so as to push the staples therein to the exit of the guide way (3). The pusher (1) is provided with a rod (11) enclosed by a spring (12), and an inverted U-shaped block (13) on the top of which is a protuberance (16).

Figure 2:
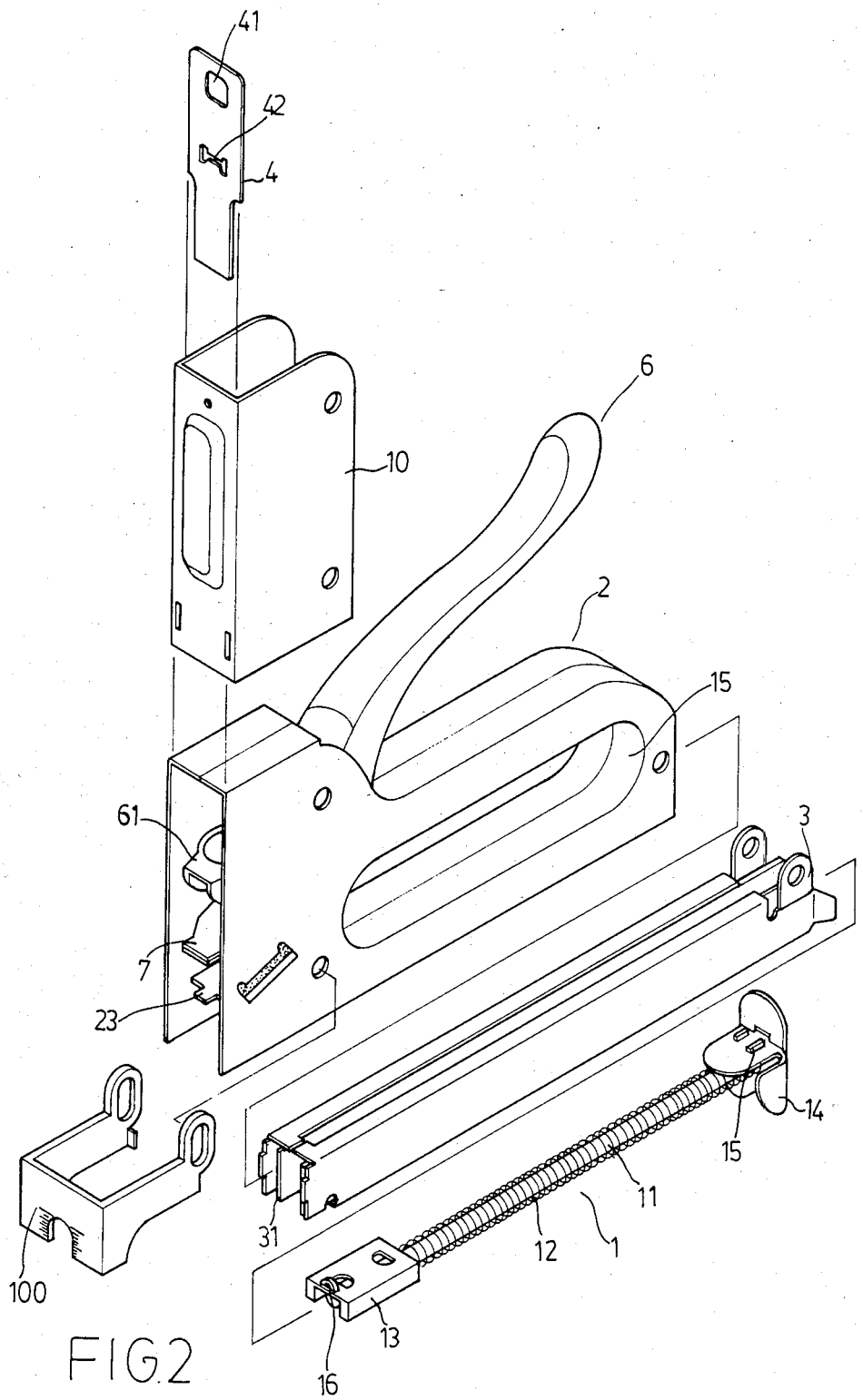
FIG. 2 is a fragmentary perspective view of the stapling gun.
Figure 3:
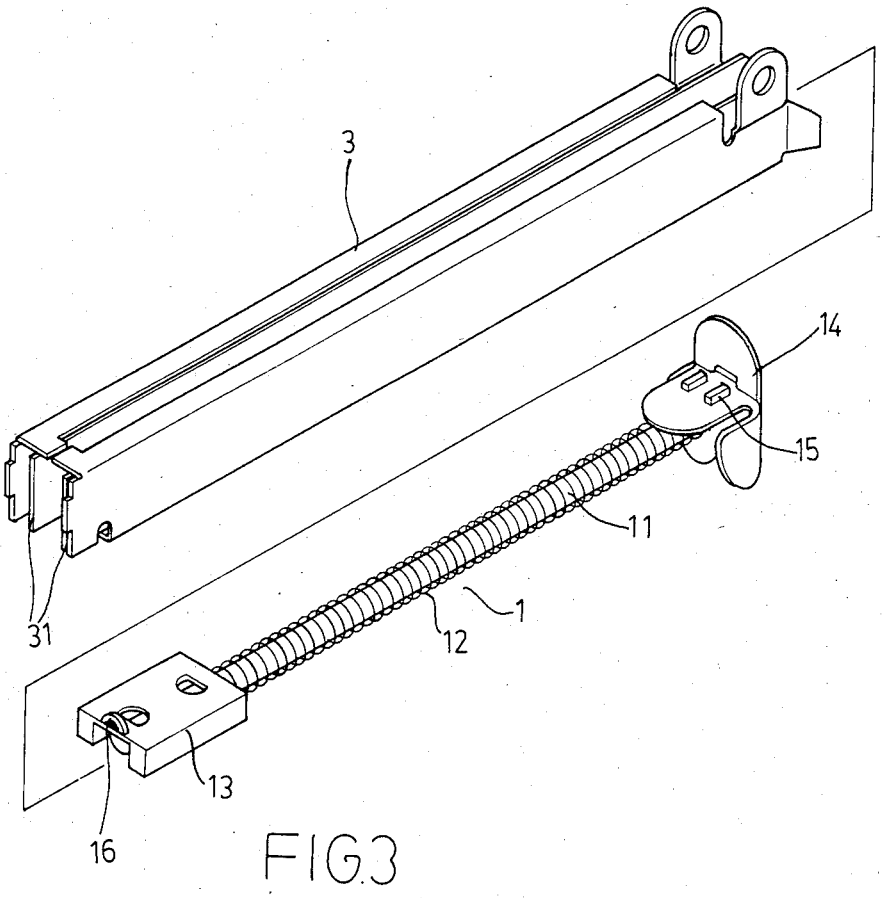
FIG. 3 is a perspective view showing the guide way and the pusher of the stapling gun.

Referring to FIG. 2 and FIG. 3, there are shown a perspective view of a guide way and a cross-sectional view of the guide way according to the present invention, respectively. As shown, the interior of the guide way (3) is provided with two vertical plates (31) along which the staples therein may be pushed by the pusher (1) to the exit of the guide way (3).

Certain terminology will be used in the following description for convenience in reference.

Referring to FIG. 10, (W), (T) and (M) designate respectively the width, the thickness and the side thickness of a staple. The widest, narrowest, thickest and thinnest are hereinafter respectively referred to the staple with largest (W), the staple with smallest (W), the staple with largest (T) and the staple with smallest (T).

Figure 4:
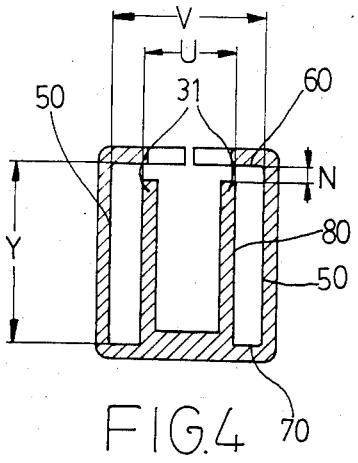
FIG. 4 is a cross-ectional view of the guide way of the stapling gun.

With reference now to FIG. 4, the horizontal distance between the two vertical plates (31) and the horizontal distance between the two vertical inner surfaces (50) are (U) and (V) respectively. Further the vertical distance between the inner top surface (60) and the top of any one of the two vertical plates (31) is (N) which is slightly greater than the thickness (T) of the thickest staples being able to be inserted into the guide way (3)

but less than two times of the thickness (T) of the thinnest staples being able to be inserted into the guide way (3). Thus, any staple with thickness (T) less than the vertical distance (N) between the inner top surface (60) and the top surface of any one of the two vertical plates (31) and width (W) larger than the horizontal distance (U) between the two vertical plates (31) but less than the horizontal distance (V) between the two vertical inner surfaces (50) can be accomodated into the guide way (3).

Figure 5:
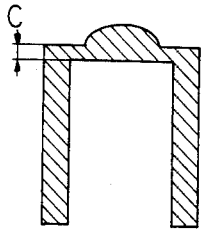
FIG. 5 is a sectional view of the inverted U-shaped block of the pusher of the stapling gun.
Figure 6:
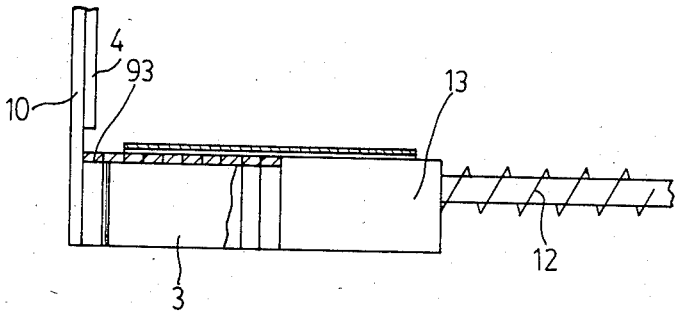
FIG. 6 shows the position of the driver relative to the staples therein in the state of using.
Figure 7:
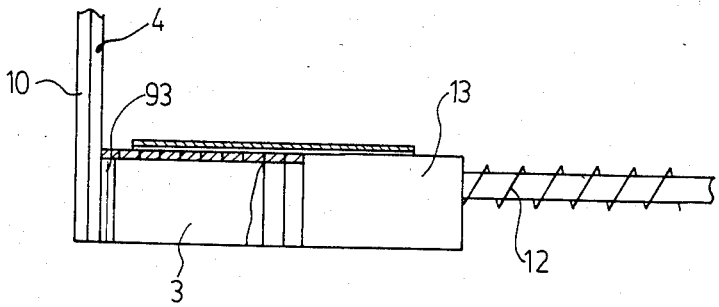
FIG. 7 shows the position of the driver relative to the staples therein in the normal state.
Figure 9A:
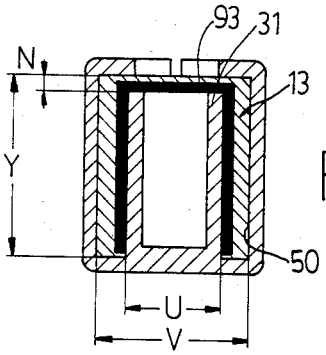
FIGS. 9a, 9b and 9c show the reason why the guide way of the stapling gun can be adapted for use with various types of staples.
Figure 9B:
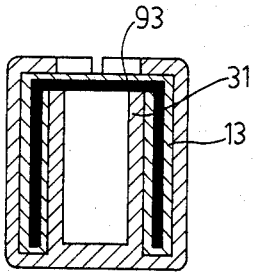
Figure 9C:
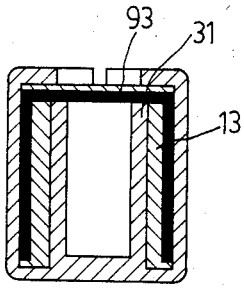

Moreover, the inverted U-shaped block (13) of the pusher (1) is slightly lower than the vertical distance (Y) between the inner top surface (60) and the inner bottom surface (70) in height, slightly less than the horizontal distance (V) between the two vertical inner surfaces (50) but larger than the horizontal distance (U) between the two vertical outer surfaces (80) in width, and is slightly less than the vertical distance (N) between the inner top surface (60) and the top surface of any one of the two vertical plates (31) in thickness (C) (as shown in FIG. 4 and FIG. 5). Consequently, there is little clearance between the pusher (1) and the guide way (3). When being used, the widest staples which can be accomodated into the guide way (3) will be urged by the spring-loaded pusher (1) to move along the two vertical inner surfaces (50) while the narrowest staples which can be accomodated into the guide way (3) will be urged by the pusher (1) to move along the two vertical outer surfaces (80). Similarly, since there is almost no clearance between the spring-loaded pusher (1) and the guide way (3), it is undoubted that the medium-sized staple which is less than the widest staple in width but larger than the narrowest staple in width can be moved steadily along the guide way (3). Further, the medium-sized staple will be kept upright between the inverted U-shaped block (13) of the pusher (1) and the convering plate (10) when the punching plate (4) is lifted by pressing the handle (6). As a result, any staple which can be inserted into the guide way (3) is able to be used with the present invention, as shown in FIG. 9.

It should be noted, however, that the guide way (3) may also be applied in desk stapler, hammer tacker, carton stapler, electric staple gun and air tacker.

It should be emphasized that the staples therein will not be splited off to fold up to obstruct the guide way (3), since the vertical distance (N) between the inner top surface (60) and the top of any one of the vertical plates (31) is less than two times of the thickness (T) of the thinnest staple (which has smallest (T)) adapted for use with the guide way (3).

Figures 8A, 8C:
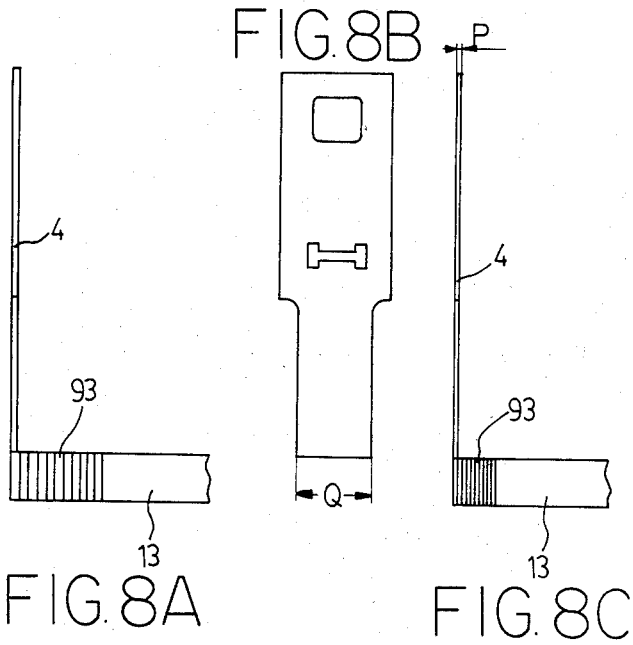

Referring to FIG. 8, the driver (4) is designed so that its thickness (P) and width (Q) are respectively slightly less than the side thickness (M) of the staple with smallest (M) which is adapted for use with the guide way and the width (V) between the two vertical inner surfaces (50) of the guide way (3). Consequently, any staples which can be inserted into the guide way (3) is able to be pressed out by the driver (4).

Figure 11:
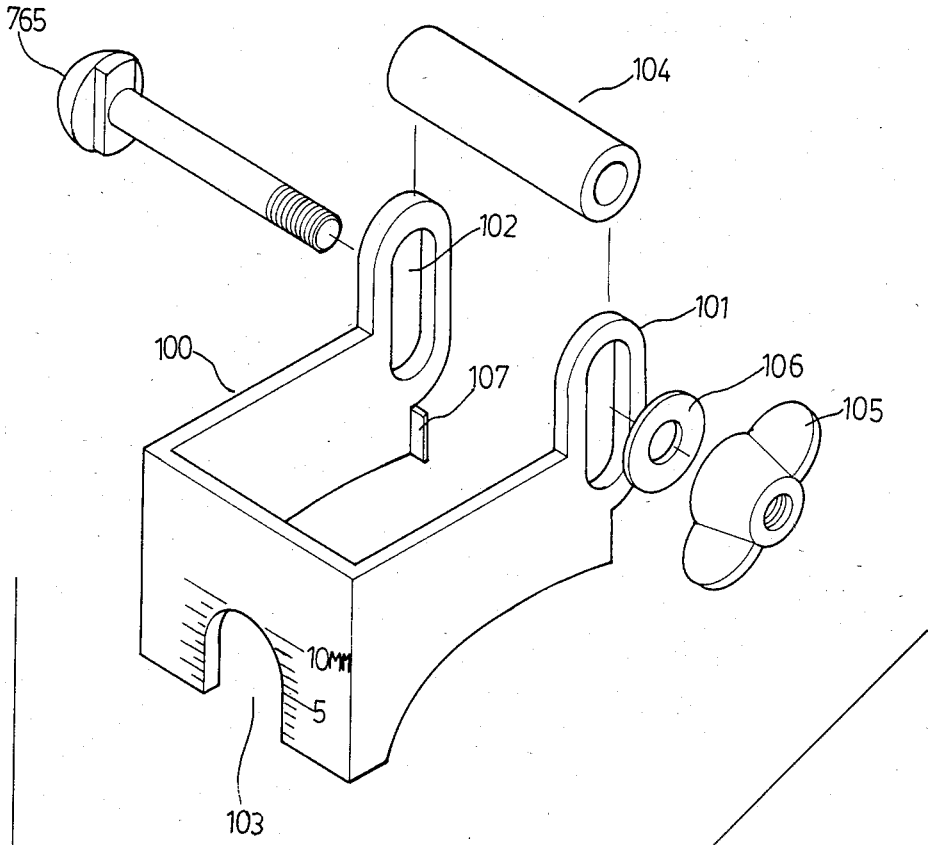
FIG. 11 is a fragmentary perspective view of the adjustable wire attachment of the stapling gun.

With reference to FIG. 1 and FIG. 11, an adjustable wire attachment (100) is mounted at the lower part of the covering plate (10). The adjustable wire attachment (100) is provided with two lugs (101) each having a slot (102), which is mounted to the covering plate (10) via a sleeve (104), a bolt (765), a washer (106), and a wing nut (105), so that the wire attachment (100) may be moved with respect to the covering plate (10) so as to adapt to wires of different diameters or the like to be held in position. Under each of the lug (101) is a fixing flange (107) which engages with the rear side of the covering plate (10) so as to hold the adjustable wire attachment (100) in position. Further, in the front of the adjustable wire attachment (100) is a notch (103) for protecting and fixing the wire to be held in position. At two sides of the notch (103) there are calibrations whereby the adjustable wire attachment (100) may be appropriately regulated so as to adapt to the wire to be held in position.

Accordingly, the present invention may be adapted for use with various kinds of staples widely used in Canada and U.S.A. such as ARROW, SWINGLINE, SENCO, SEARS CRAFTSMAN, MONTGONMERY WARD, MASTER MECHANIC, U.S.M.-BOSTIK, DUOFAST and HANSEN.

In use, first take out the pusher (1) from the main body portion (2). Then insert a strip of staples into the guide way (3). Mount the pusher (1) into the guide way (3) again, thereby forcing the staples therein to move to the exit of the guide way (3). Since the pusher (1) is spring loaded, any staple with width (W) which is greater than horizontal distance (U) between the two vertical plates (31) but less than the horizontal distance (V) between the two vertical inner surfaces (50) of the guide way (3) will surely be pushed to go forward without any difficulty. Further, since the vertical distance (N) is less than two times of the thickness (T) of the thinnest staple (which has smallest (T)) which may be accommodated into the guide way (3), the staples therein will not be splited off to fold up when pushed by the pusher (1). In order to facilitate understanding of the present invention, the parts well known in the art will not be desirbed here. Then regulate the adjustable wire attachment (100) so as to adapt to the wire or the like which is to be held in position. The greater distance the adjustable wire attachment (100) is moved down, the larger wire or the like the adjustable wire attachment (100) can accomodate. Press the handle (6) towards the main body portion (2). When the handle (6) is being pressed, the driver (4) will be first lifted to a predetermined distance, the hook (61) will be separated from the opening (41). Thus, the driver (4) will be forced by the spring leaf (7) to punch downward so as to press out a staple.

Although this invention has been described in its preferred form with a certain degree of particularity, it is understood that the present invention has been made by way of example only and that numerous changes in the detail of construction and the combination and arrangement of parts may be resorted to without departing from the spirit and scope of the invention as hereinafter claimed.

I claim:

1. A stapling gun comprising:

a main body portion;

a handle pivotally mounted on said main body portion;

a guide way mounted into the lower part of said main body portion, said guide way being provided with two vertical plates so that the vertical distance between the inner top surface of said guide way and the top of any one of the vertical plates is less than two times the thickness of the thinnest staple adapted for use with the guide way;

a pusher detachably mounted into said guide way so as to push staples accommodated in said guide way to go forward, said pusher being provided with an inverted U-shaped head portion which is just fitted between said inverted U-shaped head portion and said guide way;

a driver movably mounted into said main body portion for pressing out staples therein, said driver being slightly thinner than the side thickness of a staple with smallest side thickness which is adapted for use with said guide way and slightly less wide than the width between the two vertical inner surfaces of said guide way;

a covering plate mounted on the front of said main body portion; and an adjustable wire attachment movably mounted at the lower part of said covering plate, said adjustable wire attachment being provided with a notch for protecting and fixing a wire to be held in position, and two lugs each located at one side of said wire adjustable attachment and having a slot.

* * * * *